US009744503B2

(12) United States Patent
Kenowski

(10) Patent No.: US 9,744,503 B2
(45) Date of Patent: Aug. 29, 2017

(54) FLUID MIXING AND DISPENSING SYSTEM

(71) Applicant: Hydrite Chemical Co., Brookfield, WI (US)

(72) Inventor: Andy Kenowski, Waukesha, WI (US)

(73) Assignee: HYDRITE CHEMICAL CO., Brookfield, WI (US)

( * ) Notice: Subject to any disclaimer, the term of this patent is extended or adjusted under 35 U.S.C. 154(b) by 360 days.

(21) Appl. No.: 14/484,344

(22) Filed: Sep. 12, 2014

(65) Prior Publication Data

US 2016/0074820 A1 Mar. 17, 2016

(51) Int. Cl.

| | |
|---|---|
| ***B01F 15/02*** | (2006.01) |
| ***B01F 5/10*** | (2006.01) |
| ***B01F 15/04*** | (2006.01) |
| ***B01F 3/08*** | (2006.01) |

(52) U.S. Cl.

CPC ..... *B01F 5/10* (2013.01); *B01F 3/088* (2013.01); *B01F 3/0861* (2013.01); *B01F 15/0445* (2013.01); *B01F 2003/0896* (2013.01)

(58) Field of Classification Search

CPC ..... B01F 15/0203
USPC ..... 366/152.1, 152.2, 152.6
See application file for complete search history.

(56) References Cited

U.S. PATENT DOCUMENTS

| | | | | |
|---|---|---|---|---|
| 4,733,971 | A * | 3/1988 | Pratt | A01K 5/0216 141/107 |
| 5,219,224 | A * | 6/1993 | Pratt | A01K 5/0216 222/57 |
| 5,332,311 | A * | 7/1994 | Volk, Jr. | B01F 3/088 222/148 |
| 5,340,210 | A * | 8/1994 | Patel | B01F 3/088 366/132 |
| 5,558,435 | A * | 9/1996 | Marjo | B01F 15/00428 366/141 |
| 5,753,868 | A | 5/1998 | Diem | |
| 6,637,471 | B2 | 10/2003 | Luehrsen et al. | |
| 7,311,225 | B2 | 12/2007 | Newton | |
| 7,328,815 | B2 | 2/2008 | Lowe | |
| 7,331,483 | B2 | 2/2008 | Bhimani et al. | |
| 7,499,810 | B1 | 3/2009 | Walker | |
| 7,658,088 | B2 | 2/2010 | Walker et al. | |
| 8,342,125 | B2 | 1/2013 | Torgerson et al. | |
| 8,459,506 | B2 | 6/2013 | Schiller et al. | |
| 8,540,120 | B2 | 9/2013 | Newton et al. | |
| 8,701,937 | B2 | 4/2014 | Hoover | |
| 2011/0031272 | A1 | 2/2011 | Comiskey et al. | |

* cited by examiner

*Primary Examiner* — David Sorkin
(74) *Attorney, Agent, or Firm* — Quarles & Brady LLP

(57) ABSTRACT

A system for mixing a first fluid with one or more additional fluids to create a mixed fluid and for dispensing the mixed fluid is disclosed. The dispensing system includes a mixing tank; a first pump for the first fluid; a second pump for a second fluid; and a sensor positioned adjacent the mixing tank wherein the sensor outputs a signal based on a force exerted by the mixing tank in a direction toward the sensor. A controller of the system execute a program to: (i) receive the signal from the sensor, and (ii) operate the first pump for a first time period and operate the second pump for a second time period based on the signal from the sensor such that the first fluid and the second fluid are delivered to the mixing tank before being delivered to a storage tank for dispensing the mixed fluids.

18 Claims, 5 Drawing Sheets

FLUID MIXING AND DISPENSING SYSTEM

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The invention relates to a system for mixing a first fluid with one or more additional fluids and for dispensing the mixed fluids.

2. Description of the Related Art

Chemical dispensing systems are known in which the chemicals are supplied in concentrated form, such as solid, liquid, granulated, or powdered, and the chemical concentrate is mixed with a diluent such as water to form ready to use formulations that are thereafter distributed to a site. Preferably, the dilution ratio of chemical concentrate and diluent is carefully controlled to ensure optimum performance of the formulation at the site where the formulation is applied.

The dilution ratio of chemical concentrate and diluent can be controlled using a time-based approach. For example, a diluent pump may be run for a certain period of time to provide diluent to a mixing chamber, and a concentrate pump may be run for a certain period of time to provide concentrate to the mixing chamber. The time for operation for the diluent pump and the concentrate pump can be programmed into a control unit of the chemical dispensing system, under the assumption that the dispensed volume of diluent and concentrate over time will be consistent through repeated dispensing cycles. This type of fluid dispensing is common in the food and beverage industry. However, there are a number of problems with a time-based approach to volumetric control. Often, the volumetric flow generated by pumps is not precise, which can lead to inconsistent dispensed volume of diluent and concentrate over different dispensing cycles.

It has been proposed to use flow meters downstream of the diluent pump and the concentrate pump in a chemical dispensing system to more precisely control the dispensed volume of diluent and concentrate into a mixing chamber. However, the use of flow meters may not provide enough precision to eliminate inconsistent dispensing of diluent and concentrate over different dispensing cycles.

Certain sterilizing formulations used in the medical, veterinary and dairy fields must have a very consistent ratio of active sterilizing agent to diluent (e.g. water) in order to avoid irritating a body part being sterilized. For example, higher levels of sterilizing agent relative to diluent may lead to such irritation. In addition, poor mixing of the diluent and the concentrate in a chemical dispensing system may lead to an inconsistent ratio of diluent and concentrate throughout the volume of fluid in the mixing chamber. As a result, the ratio of diluent and concentrate will vary as the fluid in the mixing chamber is dispensed.

Therefore, there exists a need for a system for dispensing a mixture of a concentrate and a diluent in which the system provides more precise control of the ratio of diluent and concentrate in the mixed fluid.

SUMMARY OF THE INVENTION

The present invention addresses the foregoing needs by providing a system for mixing a first fluid with one or more additional fluids to create a mixed fluid and for dispensing the mixed fluid. The dispensing system includes a mixing tank; a first pump in fluid communication with the mixing tank and a first source of a first fluid; a second pump in fluid communication with the mixing tank and a second source of a second fluid; and a sensor positioned adjacent the mixing tank wherein the sensor outputs a signal based on a force exerted by the mixing tank in a direction toward the sensor. The signal from the sensor can be proportional to a weight of the first fluid and the second fluid in the mixing tank.

The dispensing system includes a controller in electrical communication with the first pump, the second pump, and the sensor. The controller is configured to execute a program stored in the controller to: (i) receive the signal from the sensor, and (ii) operate the first pump for a first time period and operate the second pump for a second time period based on the signal from the sensor such that the first fluid and the second fluid are delivered to the mixing tank. The first time period and the second time period can be based on a recipe stored in the controller. The first time period and the second time period can be based on one of a plurality of recipes stored in the controller. The controller may include an antenna for receiving a wireless transmission of the recipe. The controller can execute the program stored in the controller to operate the first pump and operate the second pump based on a predetermined time (e.g., 12 AM) from a clock.

In the dispensing system, the sensor can be positioned between the mixing tank and a support for the mixing tank. The dispensing system may include a mounting structure hinged to a support wherein the mixing tank is attached to the mounting structure. The sensor can be positioned in contact with the mounting structure and the support. In one non-limiting embodiment, the sensor is a load cell.

The controller can be programmed to operate in various manners. The controller can execute the program stored in the controller to operate the first pump for the first time period, and thereafter operate the second pump for the second time period. The controller can execute the program stored in the controller to operate the first pump for the first time period, thereafter operate the second pump for the second time period, and thereafter operate the first pump for an adjustment time period to achieve a precise selected dilution of the first fluid and the second fluid.

The dispensing system may include a mixing pump having an inlet in fluid communication with the mixing tank and an outlet in fluid communication with the mixing tank. The controller can execute the program stored in the controller to operate the mixing pump to a create a mixture of the first fluid and the second fluid. The dispensing system may include a static mixer located in the mixing tank, wherein the mixing pump circulates the first fluid and the second fluid through the static mixer to create the mixture of the first fluid and the second fluid.

The dispensing system may include a product pump having an inlet in fluid communication with the mixing tank and an outlet in fluid communication with a storage tank. The controller can execute the program stored in the controller to operate the product pump to transfer a mixture of the first fluid and the second fluid to the storage tank. The dispensing system may also include a fluid level sensor arranged in the storage tank wherein the fluid level sensor is in electrical communication with the controller. The controller can execute the program stored in the controller to operate the first pump and operate the second pump based on a signal from the fluid level sensor such that the first fluid and the second fluid are delivered to the mixing tank. The controller can execute the program stored in the controller to check for the signal from the fluid level sensor based on a predetermined time from a clock. In the dispensing system, the controller may include a data storage device. The controller can execute the program stored in the controller to record in the data storage device when the mixture of the first fluid and the second fluid is transferred to the storage tank.

The dispensing system may include a third pump in fluid communication with the mixing tank and a third source of a third fluid, wherein the controller executes the program stored in the controller to operate the third pump for a third time period based on the signal from the sensor thereby delivering the third fluid to the mixing tank.

The dispensing system may include a product selector switch in electrical communication with the controller. The controller executes the program stored in the controller to deliver the first fluid and the second fluid to the mixing tank when the product selector switch is in a first position, or to deliver the first fluid and the third fluid to the mixing tank when the product selector switch is in a second position. The first fluid can be a diluent (e.g., water), the second fluid can be a first concentrated chemical, and the third fluid can be a second concentrated chemical. Each of the concentrated chemicals can be selected such that when the concentrate is diluted with the diluent, any number of different fluid products is formed. Non-limiting example products include sterilizing products, disinfecting products, general purpose cleaning products, anti-bacterial products, deodorizing products, laundry products, automotive cleaning products, or the like.

One non-limiting example use of the dispensing system is the preparation of a disinfectant solution (i.e., teat dip) that can be applied via a cup or a sprayer to dairy animal teats to combat mastitis pathogens. Thus, in one embodiment, the present invention can be a batch delivery system used in teat dip blending on farms. This reduces solution transportation costs and provides flexibility in the products used on the farm. In another non-limiting embodiment, the dispensing system of the invention can be used for on-site manufacturing of cleaning products (e.g., a dilute sulfuric acid/hydrogen peroxide (DSP) mixture, or a trisodium phosphate (TSP) mixture) with a hot air delivery system. In another non-limiting embodiment, the dispensing system of the invention can be used for on-site chemical blending and dilutions of concentrated chemicals by weight and can deliver mixed fluids to multiple different locations. The dispensing system can be triggered by preset times, or an operator can select delivery location and recipe to be delivered manually, or the recipe can be selected by a remote trigger from a customer programmable logic controller.

A formula prepared using the dispensing system could have a plurality of different products in it and a mixing sequence can be repeated per blend; a separate tank that would be on the same scale for surfactants can be air blown to the delivery location vs. being pumped. After the final product has been delivered in a recipe, a large enough volume of water to completely flush all products from the scale to the delivery area is dispensed.

The dispensing system of the invention can include: Wi-Fi communications for program downloads and report retrieval; an auto product weighting anticipator; an auto formula adjustment to maintain proper dilutions; static tank mixing to insure proper blending; a hinge load cell bracket to support the tank for weighting; and multiple delivery locations with multiple formulas per location.

It is one advantage of the present invention to provide a system for dispensing a mixture of one or more concentrates and a diluent in which the system provides more precise control of the ratio of diluent and concentrate(s) in the mixed fluid.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
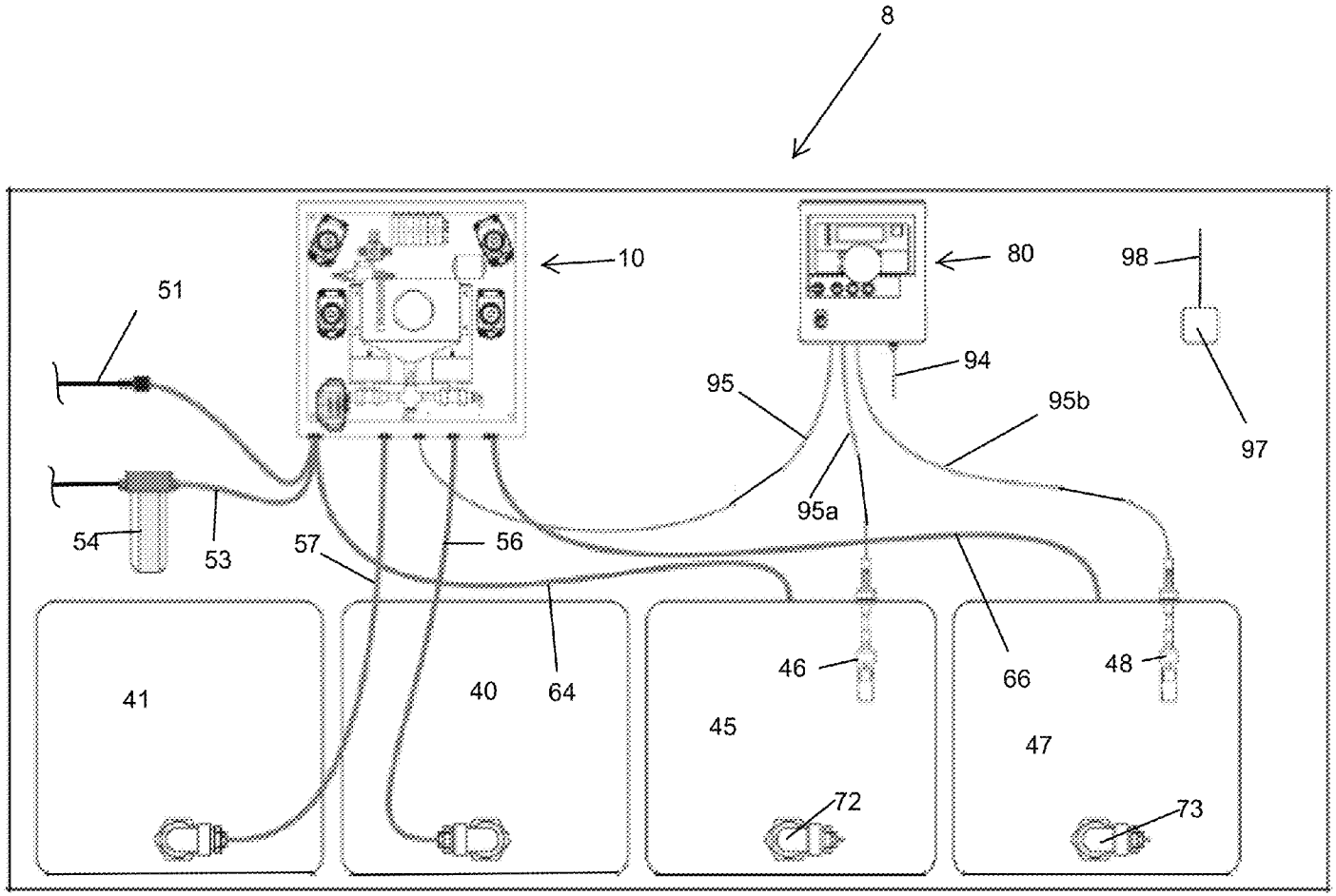
FIG. 1 is a schematic of a first embodiment of a dispensing system according to the invention.

Looking at FIGS. 1-4, there is shown a first non-limiting example embodiment of a dispensing system 8 according to the invention.

The dispensing system 8 includes a pump assembly 10 having a housing 11 defining an interior space for the pump assembly components. The pump assembly 10 includes a first mixture pump 13 (e.g., a 5.0 gallons per minute [gpm] pump) and a second mixture pump 12 (e.g., a 5.0 gpm pump). Air solenoid valves 14*a* to 14*g* receive air from an air regulator 15. A diluent (e.g., water) pump 17 is arranged in the housing 11. An electronic module 18 in electrical communication with a load cell 19 (see FIG. 4) is arranged in the housing 11. The pump assembly 10 includes a mixing pump 20 (e.g., a 5.0 gpm pump) in fluid communication with a mixing tank 21. The load cell 19 weighs the contents of the mixing tank 21 as described below.

Figure 4:
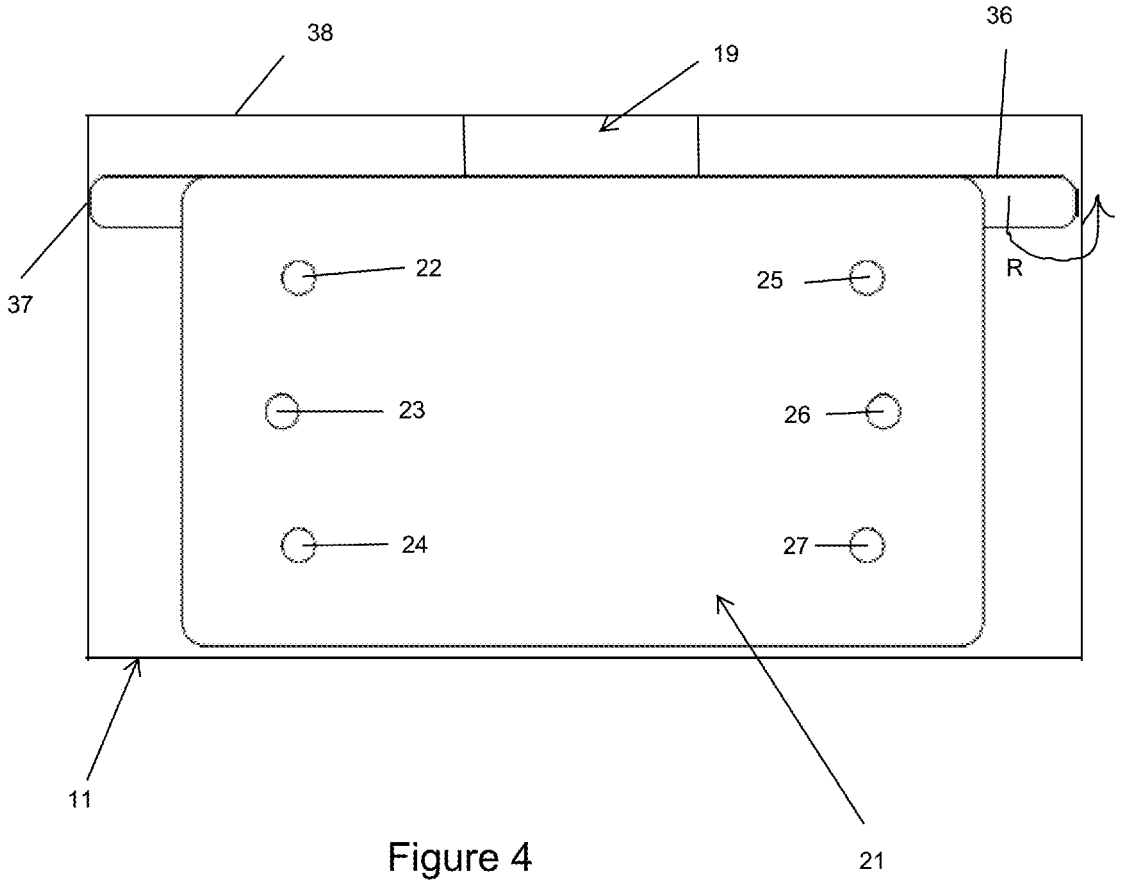
FIG. 4 is a top view of the mixing tank of the pump assembly of the dispensing system of the FIG. 1.

Turning to FIG. 4, the top wall of the mixing tank 21 has a first concentrate inlet 25, a second concentrate inlet 22, a mixing fluid inlet 23, a third concentrate inlet 24, a diluent inlet 26, and an overflow outlet 27 which can be in fluid communication with an overflow hose directed to a drain. A mounting structure 36 in the form of a plate is rotatably connected via a hinge 37 to a rear wall 38 of the housing 11. The mixing tank 21 is mounted on the mounting structure 36, which can rotate in direction R shown in FIG. 4.

Figure 3:
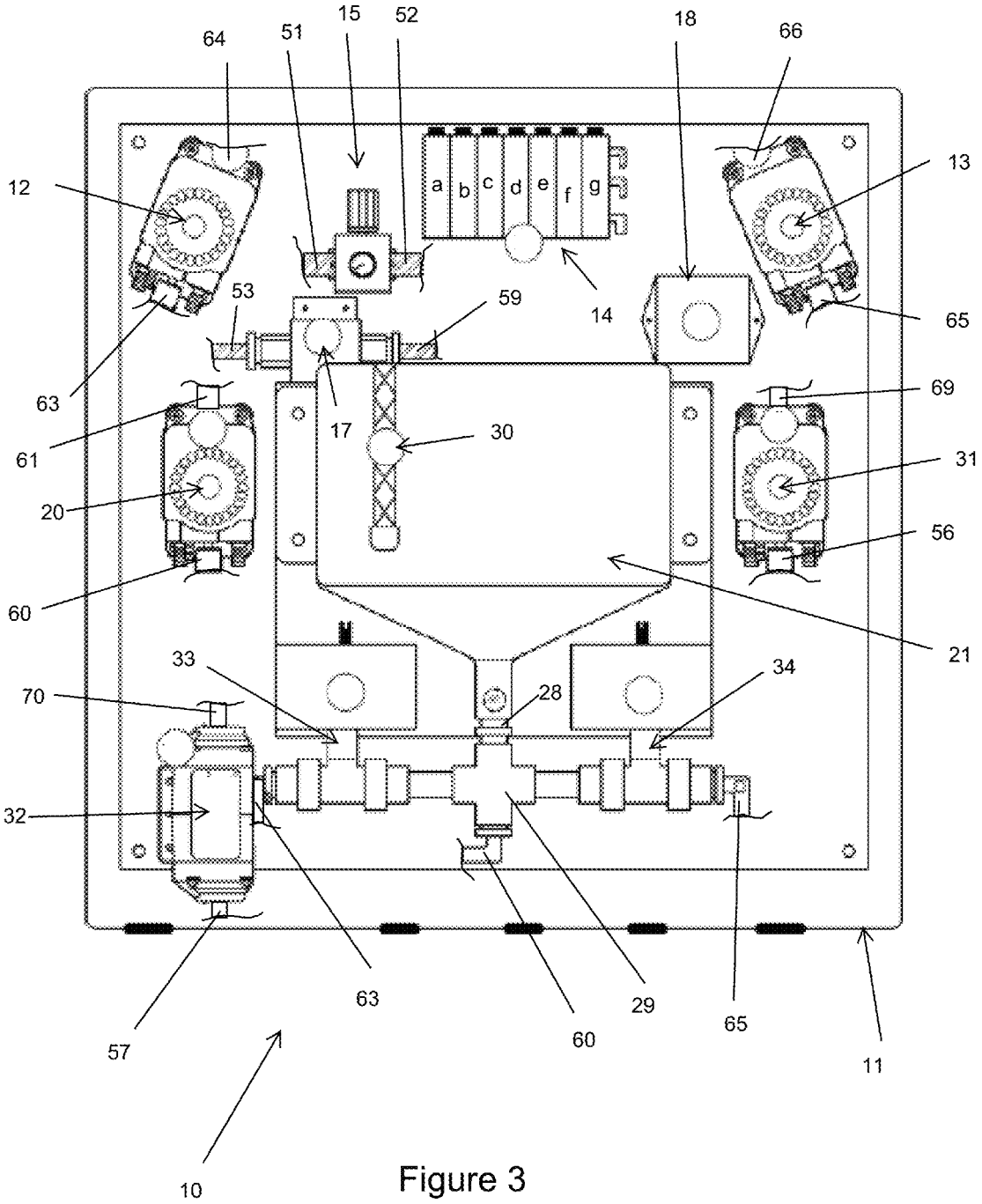
FIG. 3 is an enlarged front view of the pump assembly of the dispensing system of the FIG. 1.

Referring to FIG. 3, the mixing tank 21 has a mixture outlet 28 in fluid communication with a three way valve 29. A static mixer 30, which receives fluids being mixed from the mixing fluid inlet 23, is located in the mixing tank 21. The static mixer has tubular internals that produce desired mixing and dispersion effects as the fluid flows agitates around motionless mixer parts. The fluid flow is provided by the mixing pump 20. The pump assembly 10 includes a first concentrate pump 31 (e.g., a 5.0 gpm pump) and a second concentrate pump 32 (e.g., a 1.9 gpm pump) arranged in the housing 11. A first mixture solenoid valve 33 and a second mixture solenoid valve 34 are also arranged in the housing 11.

The dispensing system 8 includes a first concentrate reservoir 40 and a second concentrate reservoir 41 serving as sources of a first concentrate and a second concentrate, respectively. The reservoirs 40, 41 are not limited in size, but can be provided as a 55 gallon or a 250 gallon reservoir in some versions of the dispensing system 8. The first and second concentrate can be selected individually or in combination such that when the concentrate(s) are diluted with the diluent, any number of different fluid products is formed. Non-limiting example products include sterilizing products, disinfecting products, general purpose cleaning products, anti-bacterial products, deodorizing products, laundry products, automotive cleaning products, or the like.

After the diluent and the first concentrate and/or the second concentrate are proportioned and mixed in the pump assembly 10, a mixture of the first concentrate (and optionally the second concentrate) and the diluent can be stored in a first mixture storage tank 45 having a first fluid level sensor 46, and the mixture of the second concentrate (and optionally the first concentrate) and the diluent can be stored in a second mixture storage tank 47 having a second fluid level sensor 48. The first fluid level sensor 46 and the second fluid level sensor 48 can be float sensors that establish the shut-off fill level in the first mixture storage tank 45 and the second mixture storage tank 47, respectively. The dispensing system 8 will not blend more product if the float sensors indicate the storage tank is full. A light can indicate the float sensors are functioning. The first mixture storage tank 45 has a first fluid connector 72 for placing the first mixture storage tank 45 in fluid communication with a first fluid applicator such as a sprayer. The second mixture storage tank 47 has a second fluid connector 73 for placing the second mixture storage tank 47 in fluid communication with a second fluid applicator such as a sprayer. The first mixture storage tank 45 and the second mixture storage tank 47 can be sized to hold a number of days (e.g., at least five days) of ready to use formula based on the typical use rate of the formulations.

Looking at FIGS. 1, 3, and 4, fluid conduits that connect the above described components of the dispensing system 8 are shown. In FIG. 3, fragmentary views of the fluid conduits are used for ease of illustration. An air intake conduit 51 provides air to the air regulator 15 which controls delivery of air to the air solenoid valves 14*a* to 14*g* via an air supply conduit 52. A diluent supply conduit 53 provides a diluent (e.g., water) through a back flow preventer and a filter 54 to the diluent pump 17. A diluent pump outlet conduit 59 transports diluent from the diluent pump 17 to the diluent inlet 26 of the mixing tank 21.

Still looking at FIGS. 1, 3, and 4, a first concentrate feed conduit 56 provides the first concentrate from the first concentrate reservoir 40 to the first concentrate pump 31. A second concentrate feed conduit 57 provides the second concentrate from the second concentrate reservoir 41 to the second concentrate pump 32. A first mixing conduit 60 transports fluids being mixed from the three way valve 29 to the mixing pump 20. A second mixing conduit 61 transports fluids being mixed from the mixing pump 20 to the mixing fluid inlet 23 of the mixing tank 21. A first mixture pump inlet conduit 63 transports a first mixture from the three way valve 29 to the first mixture pump 13. A first mixture pump outlet conduit 64 transports the first mixture from the first mixture pump 13 to the first mixture storage tank 45. A second mixture pump inlet conduit 65 transports a second mixture from the three way valve 29 to the second mixture pump 12. A second mixture pump outlet conduit 66 transports the second mixture from the second mixture pump 12 to the second mixture storage tank 47. A first concentrate pump outlet conduit 69 transports the first concentrate from the first concentrate pump 31 to the first concentrate inlet 25 of the mixing tank 21. A second concentrate pump outlet conduit 70 transports second concentrate from the second concentrate pump 32 to the second concentrate inlet 22 of the mixing tank 21.

Figure 2:
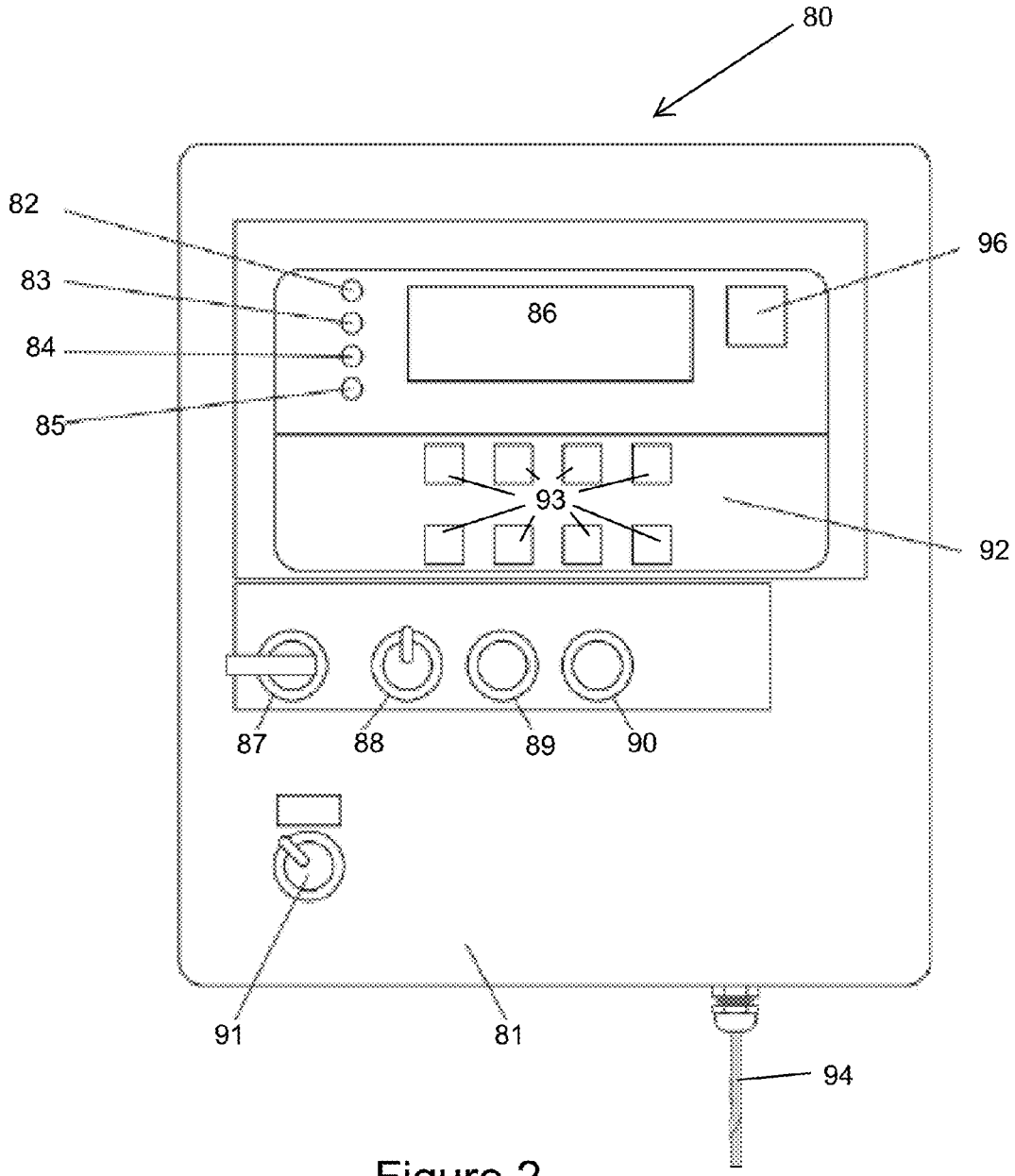
FIG. 2 is an enlarged front view of the controller of the dispensing system of the FIG. 1.

Referring now to FIGS. 1 and 2, the dispensing system 8 includes a controller 80. The dispensing system 8 is activated by the controller 80 to proportion and mix the first concentrate, and/or the second concentrate and the diluent and store the mixed fluids in the first mixture storage tank 45 and second mixture storage tank 47. Generally, the controller may be a programmable logic controller (PLC) that controls activation of the pumps 12, 13, 17, 20, 31, 32, and air solenoid valves 14*a* to 14*g*. Air solenoid valve 14*a* controls the flow of the first concentrate to the mixing tank 21. Air solenoid valve 14*b* controls the flow of the second concentrate to the mixing tank 21. Air solenoid valve 14*c* controls the flow of the third concentrate to the mixing tank 21. Air solenoid valve 14*d* controls the flow of diluent to the mixing tank 21. Air solenoid valve 14*e* controls the recirculation of the solution in the mixing tank 21 through the static mixer 30. Air solenoid valve 14*f* controls the flow from the mixing tank 21 to the first mixture storage tank 45. Air solenoid valve 14*g* controls the flow from the mixing tank 21 to the second mixture storage tank 47. The air solenoid valves 14*a* to 14*g* are mounted on a manifold.

The controller 80 has a housing 81 supporting a second mixture blending light 82, a first mixture blending light 83, a second mixture tank full light 84, a first mixture tank full light 85, an LED display panel 86, a cursor movement dial 87, a product selector switch 88, a recipe selector button 89, a recipe actuation button 90, an on/off switch 91, a function selection panel 92, function buttons 93 (e.g., F1, F2, F2, F4, BACK, FWD, DN/PREV and UP/NEXT), an antenna 94 for wireless communication with a Wi-Fi antenna 98 of a router 97, a communication cable 95 in electrical communication with electronic module 18, a communication cable 95*a* in electrical communication with the first fluid level sensor 46, a communication cable 95*b* in electrical communication with the second fluid level sensor 48, and a display adjustment button 96.

Having described the construction of the dispensing system 8, the operation of the dispensing system 8 can now be described. The dispensing system 8 utilizes the mixing tank 21 with the load cell 19 to blend the concentrated chemical ingredients with a diluent (e.g., water) into two finished ready to use formulations. Each concentrate used is pumped into the mixing tank 21 and weighed. The mixing pump 20 recirculates the solution in the mixing tank 21 through the static mixer 30 to thoroughly blend the finished product. The finished product is then pumped from the mixing tank 21 to one of the first mixture storage tank 45 and the second mixture storage tank 47. While the dispensing system 8 has been illustrated as producing two ready to use products from two concentrates, FIG. 5 (described below) shows how additional chemical ingredients can be used in a dispensing system of the invention.

In one non-limiting example operation sequence for the dispensing system 8, the controller 80 initiates a time of day blending start in which an internal clock triggers the system to look at the storage tank float levels via the first fluid level sensor 46 and the second fluid level sensor 48. If the float level is below a predetermined fill level in the first mixture storage tank 45 and/or the second mixture storage tank 47 as measured by the first fluid level sensor 46 and the second fluid level sensor 48, the controller advances to a float "low" process step in which mixing begins. The first mixture blending light 83 and the second mixture blending light 82 are activated when producing the selected product. The diluent pump 17, the first concentrate pump 31 and/or the second concentrate pump 32 dispense diluent and concentrate(s) into the mixing tank 21. The fluids are circulated through the static mixer 30 before the mixing tank 21 is emptied into the first mixture storage tank 45 and/or the second mixture storage tank 47. The controller 80 logs data in real time in a data storage device. For example, usage per day of the diluent, the first concentrate, and the second concentrate can be stored in the data storage device.

When using the controller 80 for the first time, one presses an "F4" button of the function buttons 93 to load a configuration file received from the router 97. The configuration file will load and can be saved by pressing an "F1" button of the function buttons 93. Alternatively, the configuration file can be loaded from a memory device (e.g., an SD card). Configuration file updates may be received periodically from the router 97.

The controller 80 performs a system check in which system faults are detected. Non-limiting example system faults are: a concentrate reservoir is empty; no air; low air pressure; valve(s) are not opening; diluent supply (e.g., water) is turned off; diluent is frozen; concentrate is cold; loss of power; mixing tank has product in it; additional weight is on the mixing tank; a hose is applying pressure to the mixing tank; door is applying pressure to the mixing tank; communication cable(s) are disconnected from controller; and/or the load cell is defective or load cell wires are disconnected.

The product selector switch 88 is then used to choose between a first formulation and a second formulation. The recipe actuation button 90 is pressed so that a recipe screen appears on the display panel 86. The cursor movement dial 87 can be used to scroll through the recipe list and the recipe actuation button 90 can be used to select a recipe. It can be appreciated that numerous formulation recipes are possible. As non-limiting examples, the first formulation could have 1% by weight of the first concentrate in diluent, or 2% by weight of the first concentrate in diluent, 3% by weight of the first concentrate in diluent, etc. The second formulation could have 1% by weight of the second concentrate in diluent, 2% by weight of the second concentrate in diluent, or 3% by weight of the second concentrate in diluent, etc. In addition, both the first concentrate and the second concentrate can be used in various percentages in the first formulation and/or the second formulation.

Once the recipe is selected, the controller 80 activates the dispensing system 8 to add diluent (e.g., water) to the mixing tank 21 using the diluent pump 17 according to a desired weight programmed in the recipe. As the water is added to the mixing tank 21 thereby adding weight to the mixing tank 21, the load cell 19 will sense an increase in force as the load cell 19 is in contact with the mounting structure 36 and the rear wall 38 of the housing 11. The mixing tank 21 rotates in direction R shown in FIG. 4 creating a force exerted by the mixing tank 21 and mounting structure 36 in a direction toward the load cell 19. The signal from the load cell 19 to the controller communicated via the electronic module 18 is proportional to the weight of the diluent in the mixing tank 21. The program stored in the controller 80 can convert the signal from the load cell 19 to a weight, and dispensing of the diluent is stopped when the weight programmed in the recipe (e.g., 8 oz.) is reached.

In a next process step of the program stored in the controller 80, the controller 80 activates the dispensing system 8 to add the first concentrate (e.g., iodine as an active ingredient) to the mixing tank 21 using the first concentrate pump 31. The first mixture blending light 83 is activated when producing the selected product. As the first concentrate is added to the mixing tank 21, the weight of the diluent and the first concentrate in the mixing tank 21 increases as explained above for the diluent filling step. In one version of the program stored in the controller 80, snapshots of the specific gravity of the fluid in the mixing tank 21 are derived from the load cell signal in millisecond time frames. The program stored in the controller 80 can account for air factors in adding the first concentrate to the diluent, i.e., the first concentrate passes through air before contacting the diluent. Dispensing of the first concentrate is stopped when the weight programmed in the recipe is reached.

The amount of the first concentrate delivered by the first concentrate pump 31 may vary. Therefore, in a next process step of the program stored in the controller 80, the controller 80 activates the dispensing system 8 to add diluent (e.g., water) to the mixing tank 21 using the diluent pump 17 to adjust for the actual amount of the first concentrate that was dispensed. As noted above, the program stored in the controller 80 can convert the signal from the load cell 19 to a weight, and dispensing of the diluent is stopped when the weight programmed in the recipe is reached.

Optionally, in a next process step of the program stored in the controller 80, the controller 80 activates the dispensing system 8 to add the second concentrate (e.g., an emollient as a conditioning agent, a surfactant, and/or an activator) to the mixing tank 21 using the second concentrate pump 32. As the second concentrate is added to the mixing tank 21, the weight of the diluent and the first concentrate and the second concentrate in the mixing tank 21 increases as explained above for the diluent and first concentrate filling step. Dispensing of the second concentrate is stopped when the weight programmed in the recipe is reached.

The amount of the second concentrate delivered by the second concentrate pump 32 may vary. Therefore, in a next process step of the program stored in the controller 80, the controller 80 activates the dispensing system 8 to add diluent (e.g., water) to the mixing tank 21 using the diluent pump 17 to adjust for the actual amount of the second concentrate that was dispensed. As noted above, the program stored in the controller 80 can convert the signal from the load cell 19 to a weight, and dispensing of the diluent is stopped when the weight programmed in the recipe is reached.

In a next process step of the program stored in the controller 80, the controller 80 activates the mixing pump 20 to recirculate the solution in the mixing tank 21 through the static mixer 30 for a time period programmed in the controller 80 to thoroughly blend the finished product. The controller 80 places the three way valve 29 in a first position in which the first mixing conduit 60 transports the fluids being mixed from the three way valve 29 to the mixing pump 20 and then to the second mixing conduit 61 which transports the fluids being mixed from the mixing pump 20 to the mixing fluid inlet 23 of the mixing tank 21.

In a next process step of the program stored in the controller 80, the controller 80 places the three way valve 29 in a second position in which the finished product is pumped from the mixing tank 21 through opened first mixture solenoid valve 33 and to the first mixture storage tank 45 via the first mixture pump outlet conduit 64. The first mixture tank full light 85 will light if the first mixture storage tank 45 is full as sensed by the first fluid level sensor 46 which provides feedback to the controller 80. The first mixture storage tank 45 may include a product label with a product formulation number from the configuration file, an active ingredient percentage, a conditioner percentage, and the intended use of the formulation.

The process steps above for the controller 80 for the first formulation can be repeated for creating a second formulation for storage in the second mixture storage tank 47. During this process, the second mixture blending light 82 is activated. After the controller 80 places the three way valve 29 in the first position, the controller 80 activates the mixing pump 20 to thoroughly blend the finished product. The controller 80 then places the three way valve 29 in a third position in which the finished product is pumped from the mixing tank 21 through opened second mixture solenoid valve 34 and to the second mixture storage tank 47 via the second mixture pump outlet conduit 66. The second mixture tank full light 84 will light if the second mixture storage tank 47 is full as sensed by the second fluid level sensor 48 which provides feedback to the controller 80.

After the finished product is pumped from the mixing tank 21 to the first mixture storage tank 45 or to the second mixture storage tank 47, the active pump is operated to zero weight as measured by calibrated load cell 19. Once a zero weight value is reached on the load cell 19, the dispensing system 8 continues to attempt to deliver the product for a preset period of time to ensure the mixing tank 21 is empty.

Figure 5:
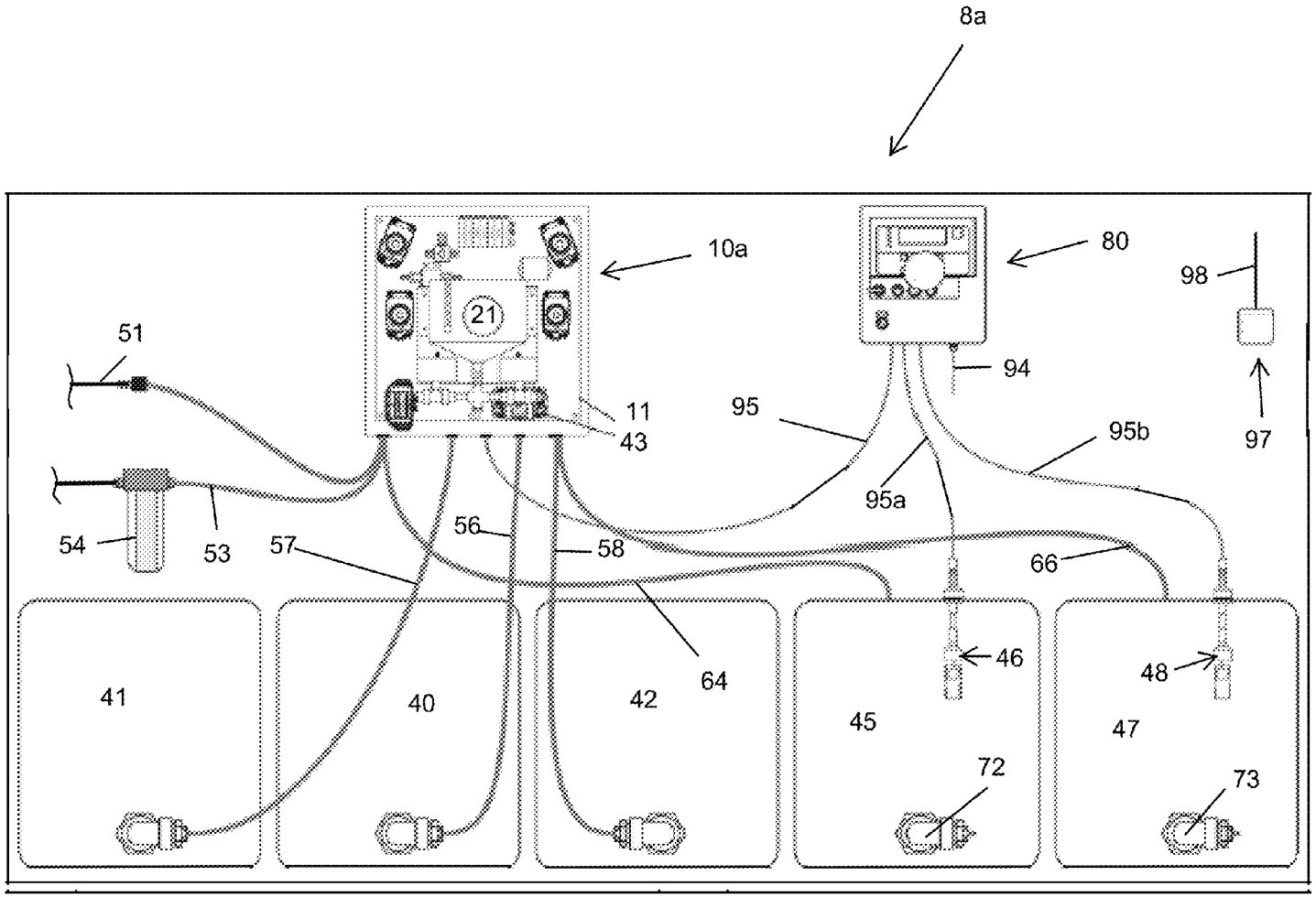
FIG. 5 is a schematic of a second embodiment of a dispensing system according to the invention.

Turning now to FIG. 5, there is shown a second non-limiting example embodiment of a dispensing system 8*a* according to the invention. The dispensing system 8*a* is similar to dispensing system 8 so like reference numerals will be used to refer to like parts in the dispensing system 8*a* and the dispensing system 8. The dispensing system 8*a* includes a third concentrate reservoir 42 for containing a third concentrate. The reservoir 42 is not limited in size, but can be provided as a 55 gallon or a 250 gallon reservoir in some versions of the dispensing system 8*a*. A third concentrate pump 43 (e.g., a 5.0 gpm pump) is placed in fluid communication with a third concentrate feed conduit 58 for transporting the third concentrate from the third concentrate reservoir 42 to the third concentrate inlet 24 of the mixing tank 21. The third concentrate pump 43 is part of the pump assembly 10*a*.

The process steps above for the controller 80 can be used for creating a formulation for storage in the first mixture storage tank 45 or the second mixture storage tank 47. A process step of this program stored in the controller 80 activates the dispensing system 8*a* to add the third concentrate to the mixing tank 21 using the third concentrate pump 43. As the third concentrate is added to the mixing tank 21, the weight of the diluent and the third concentrate (and the first concentrate and/or the second concentrate) in the mixing tank 21 increases as explained above. Dispensing of the third concentrate is stopped when the weight programmed in the recipe is reached. After the controller 80 activates the mixing pump 20 to thoroughly blend the finished product, the finished product is then pumped from the mixing tank 21 to the first mixture storage tank 45 or the second mixture storage tank 47.

Thus, the invention provides a gravimetric system for mixing a first fluid with one or more additional fluids and for storing the mixed fluids for dispensing.

Although the present invention has been described in detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A system for mixing a first fluid with one or more additional fluids to create a mixed fluid and for dispensing the mixed fluid, the system comprising:

a mixing tank;

a first pump in fluid communication with the mixing tank and a first source of a first fluid;

a second pump in fluid communication with the mixing tank and a second source of a second fluid;

a sensor positioned adjacent the mixing tank, the sensor outputting a signal based on a force exerted by the mixing tank in a direction toward the sensor; and a controller in electrical communication with the first pump, the second pump, and the sensor, the controller being configured to execute a program stored in the controller to: (i) receive the signal from the sensor, and (ii) operate the first pump for a first time period and operate the second pump for a second time period based on the signal from the sensor such that the first fluid and the second fluid are delivered to the mixing tank, wherein the controller executes the program stored in the controller to operate the first pump for the first time period, thereafter operate the second pump for the second time period, and thereafter operate the first pump for an adjustment time period to achieve a selected dilution of the first fluid and the second fluid.

2. The system of claim 1 wherein:

the sensor is positioned between the mixing tank and a support for the mixing tank.

3. A system for mixing a first fluid with one or more additional fluids to create a mixed fluid and for dispensing the mixed fluid, the system comprising:

a mixing tank;

a first pump in fluid communication with the mixing tank and a first source of a first fluid;

a second pump in fluid communication with the mixing tank and a second source of a second fluid;

a sensor positioned adjacent the mixing tank, the sensor outputting a signal based on a force exerted by the mixing tank in a direction toward the sensor; and a controller in electrical communication with the first pump, the second pump, and the sensor, the controller being configured to execute a program stored in the controller to: (i) receive the signal from the sensor, and (ii) operate the first pump for a first time period and operate the second pump for a second time period based on the signal from the sensor such that the first fluid and the second fluid are delivered to the mixing tank, and a mounting structure hinged to a support, wherein the mixing tank is attached to the mounting structure, and wherein the sensor is positioned in contact with the mounting structure and the support.

4. The system of claim 1 wherein:

the sensor is a load cell.

5. A system for mixing a first fluid with one or more additional fluids to create a mixed fluid and for dispensing the mixed fluid, the system comprising:

a mixing tank;

a first pump in fluid communication with the mixing tank and a first source of a first fluid;

a second pump in fluid communication with the mixing tank and a second source of a second fluid;

a sensor positioned adjacent the mixing tank, the sensor outputting a signal based on a force exerted by the mixing tank in a direction toward the sensor; and a controller in electrical communication with the first pump, the second pump, and the sensor, the controller being configured to execute a program stored in the controller to: (i) receive the signal from the sensor, and (ii) operate the first pump for a first time period and operate the second pump for a second time period based on the signal from the sensor such that the first fluid and the second fluid are delivered to the mixing tank, and a mixing pump having an inlet in fluid communication with the mixing tank and an outlet in fluid communication with the mixing tank, wherein the controller executes the program stored in the controller to operate the mixing pump to a create a mixture of the first fluid and the second fluid, and a static mixer located in the mixing tank, wherein the mixing pump circulates the first fluid and the second fluid through the static mixer to create the mixture of the first fluid and the second fluid.

6. The system of claim 5 wherein:

the static mixer includes internals that produce desired mixing as the first fluid and the second fluid flow around motionless mixer parts.

7. The system of claim 1 further comprising:

a product pump having an inlet in fluid communication with the mixing tank and an outlet in fluid communication with a storage tank, wherein the controller executes the program stored in the controller to operate the product pump to transfer a mixture of the first fluid and the second fluid to the storage tank.

8. The system of claim 7 further comprising:

a fluid level sensor arranged in the storage tank, the fluid level sensor being in electrical communication with the controller, wherein the controller executes the program stored in the controller to operate the first pump and operate the second pump based on a signal from the fluid level sensor such that the first fluid and the second fluid are delivered to the mixing tank.

9. The system of claim 8 wherein:

the controller executes the program stored in the controller to check for the signal from the fluid level sensor based on a predetermined time from a clock.

10. The system of claim 7 wherein:

the controller includes a data storage device, and the controller executes the program stored in the controller to record in the data storage device when the mixture of the first fluid and the second fluid is transferred to the storage tank.

11. The system of claim 1 further comprising:

a third pump in fluid communication with the mixing tank and a third source of a third fluid, wherein the controller executes the program stored in the controller to operate the third pump for a third time period based on the signal from the sensor.

12. The system of claim 11 further comprising:

a product selector switch in electrical communication with the controller, wherein the controller executes the program stored in the controller to deliver the first fluid and the second fluid to the mixing tank when the product selector switch is in a first position, or deliver the first fluid and the third fluid to the mixing tank when the product selector switch is in a second position.

13. The system of claim 12 wherein:

the first fluid is a diluent, the second fluid is a first concentrated chemical, and the third fluid is a second concentrated chemical.

14. The system of claim 1 wherein:

the first time period and the second time period are based on a recipe stored in the controller.

15. The system of claim 14 wherein:

the controller includes an antenna for receiving a transmission of the recipe.

16. The system of claim 1 wherein:

the first time period and the second time period are based on one of a plurality of recipes stored in the controller.

17. The system of claim 1 wherein:

the controller executes the program stored in the controller to operate the first pump and operate the second pump based on a predetermined time from a clock.

18. The system of claim 1 wherein:

the signal from the sensor is proportional to a weight of the first fluid and the second fluid in the mixing tank.

* * * * *